United States Patent [19]

Jason et al.

[11] 3,949,537

[45] Apr. 13, 1976

[54] APPARATUS FOR PACKAGING

[75] Inventors: Henry Jason; Christopher Richard Eddison, both of Watford, England

[73] Assignee: Hayssen Manufacturing Company, Sheboygan, Wis.

[22] Filed: Nov. 26, 1974

[21] Appl. No.: 527,287

Related U.S. Application Data

[62] Division of Ser. No. 314,908, Dec. 14, 1972, Pat. No. 3,861,114.

[30] Foreign Application Priority Data

May 3, 1972 United Kingdom ..... 20594/72

[52] U.S. Cl. ..... 53/226

[51] Int. Cl.[2] ..... B65B 11/02

[58] Field of Search ..... 53/30, 32, 33, 34, 184, 53/221, 222, 223, 226; 93/54.2, 60

[56] References Cited

UNITED STATES PATENTS

| | | | |
|---|---|---|---|
| 1,392,683 | 10/1921 | Hackett | 53/221 |
| 1,424,363 | 8/1922 | Leuman | 53/226 X |
| 2,757,499 | 8/1956 | Albecht | 53/226 |
| 3,662,513 | 5/1972 | Fabbri | 53/226 X |

*Primary Examiner*—Travis S. McGehee
*Assistant Examiner*—John Sipos
*Attorney, Agent, or Firm*—Cushman, Darby & Cushman

[57] ABSTRACT

Articles are wrapped in packaging film or foil by folding a sheet of film or foil round them. The film or foil is first folded round the article by four equi-spaced folding blades to leave four pleats of film or foil, and these pleats are then formed by second folding blades into neatly bunched ribs.

6 Claims, 4 Drawing Figures

APPARATUS FOR PACKAGING

This is a division, of application Ser. No. 314,908 filed Dec. 14, 1972 now U.S. Pat. No. 3,861,114.

This invention relates to apparatus for packaging. More particularly this invention relates to apparatus for over-wrapping and sealing trays carrying perishable goods, for example, meats, fruit and vegetables, with a foil, e.g. a transparent packaging film or foil or metal foil.

According to the present invention, a method of overwrapping an article comprises locating a sheet of wrapping foil adjacent the article, moving the article relative to the sheet so as to contact the wrapping foil with the article and drape the foil around the article, first smoothing the foil around the article inwardly from four positions equispaced about the article towards the centre of the article and thereafter bunching the remaining pleats of foil into four bunched ribs, each extending from the edge of the article toward a common point.

The invention also provides packaging apparatus for carrying out the method just defined, and comprising foil feed and clamp means, an article lift located below the foil feed and clamp means and, located above the feed and clamp means, a first set of folding blades movable radially from a closed position vertically disposed above the lift in which they mate or almost mate to form a closed surface, the mating lines being in the form of a cross, to an open position clear of above the lift, and a second set of folding blades each movable radially from an open position to a closed position in which each blade is adjacent and just above one of the mating lines between two adjacent blades of the first set.

A tray to be over-wrapped will usually be of rectangular shape, most often of square, one and a half squares, or two square shape. However, in practice, a wide variety of shaped articles can be overwrapped according such apparatus, for example, round food-containing trays, cabbages and even chickens. The folding blades and associated means further disclosed below should match the shape of the tray and different sets may be required for different shaped trays. In a complete wrapping maching, e.g. for supermarket use, a plurality of stations may be provided in the machine, each including a package lift and folding blades, there being a common tray feed mechanism to convey a tray through the device and means for detecting the length and size of the tray and for causing the appropriate wrapping station to operate. The control and sensing means for this are standard and require no detailed explanation here.

The foil feed and clamp means may be any suitable means which will feed foil, e.g. from a stock roll, to the over-wrapping station and hold the foil satisfactorily during wrapping. The feed may include one or more driven rollers, some of which may be provided with brakes to overcome overrun. The guiding of the leading edge of the foil may be effected by a mechanical clamp, suction bar or the like. Suitable foil clamps are horizontal ring or bar clamps located above the lift, the foil being clamped when desired between two mating rings, or between bars of identical size, urged together by any convenient means. Such rings or bars may have non slip or high friction facings or coatings, e.g. of rubber. Brushes may be provided adjacent the foil clamp to smooth the foil over the pack.

Means may be provided to cut, e.g. by hot wire, foil from a stock roll to free a section to be used for over-wrapping each package.

The foil used may be of any convenient type e.g. a metal foil. However, plastics foils are preferred which may be self sealing or heat sealable, and may be heat shrinkable or otherwise. In the case of heat sealable and of heat shrinkable films, the apparatus may include heating chambers, tables, tunnels or the like to effect a supply of heat when necessary.

The folding blades may be shaped to suit the shape of the package to be overwrapped. In the case of a square package, a preferred shape for the first folding blades is that of a right angled isosceles triangle. The second set of blades are generally elongate, having an end adapted to fold up a pleat of hanging foil into a neat rib. For this purpose, the ends of the second blades are preferably re-entrant. A set of two opposing package clamps may hold the elevated pack to provide clearance between the bottom of the pack and the lift table.

While in the closed position the first set of folding blades are preferably substantially coplanar, this is not necessarily the case for the second set of blades. In the case of the second set, it is possible, for example, to have opposite pairs of coplanar blades in two adjacent planes. If one pair is adapted to close before the other, this can result in a neat bunching of the end of the ribs beneath the centre of the package. The exact amount of bunching will depend upon the size of the portion of foil used for overwrapping.

The movement of the folding blades is radial with respect to the axis of the package lift; in planes perpendicular thereto the movement may be rectilinear or arcuate. One preferred method of arranging the apparatus is to mount the second folding blades slidably on the first. In use of apparatus including package clamps the operation may be for example that a set of clamps swing arcuately into position to locate and effect a controlled grip on the package. This is followed by the first folding blades swinging arcuately into position, whereafter the second folding blades are advanced radially and in rectilinear fashion sliding on the first folding blades.

The edges and corners of the folding blades should be radiused to prevent tearing of the foil.

It will be appreciated that if the foil is generously draped around the package, even after the two sets of folding blades have been closed up, a "tail" of foil may be left protruding downwardly centrally of the package. This may be tamped flat if desired, e.g. by a tamping plug set in the package lift. Tamping or neatening of the tail may be assisted by twisting the package or by twisting a tamping plug.

The invention is illustrated, merely by way of example, with reference to the accompanying drawings in which.

Figure 1:
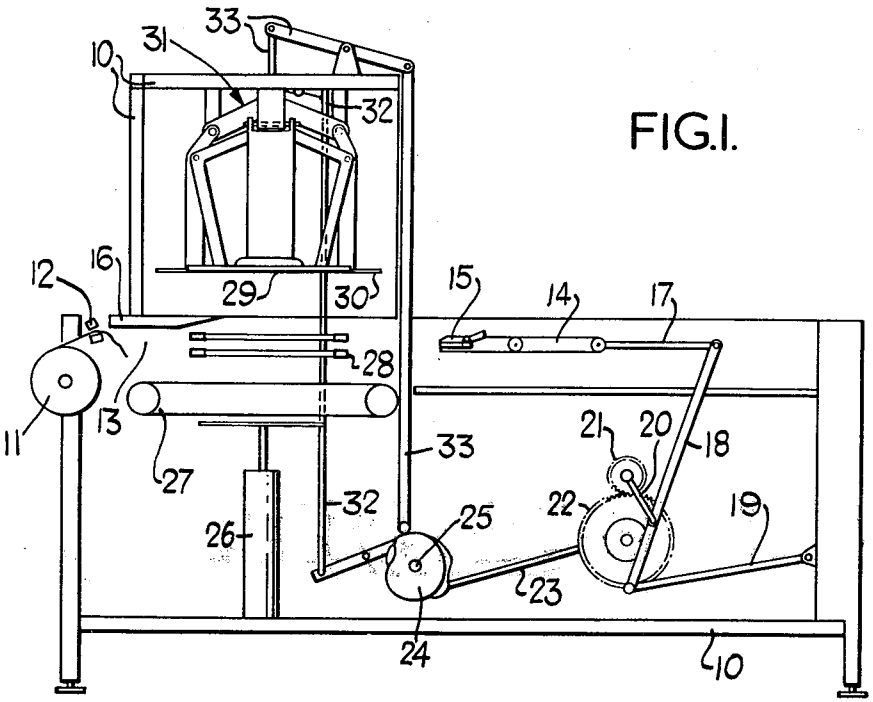
FIG. 1 is a side schematic view of a wrapping maching according to the present invention.

Referring first to FIG. 1, the machine is built onto a frame 10 which serves to hold the various operative parts. The exact constructional details are omitted in FIG. 1 for the sake of clarity, but it may be assumed that all the various fixed parts detailed below are attached to this frame.

Mounted at one end of the frame is a wrapping foil supply roll 11 with feed check means 12 and a hot wire foil cutter 13. A sliding carriage 14 may be reciprocated to and from roll 11. The front end of the carriage 14 bears jaws 15 for grasping the leading edge of foil from roll 11, these jaws being opened when the carriage 14 is advanced by means of a wedge shaped riser 16 mounted on frame 10. The rear end of carriage 14 is connected by a link rod 17 to a reciprocating arm 18, fixed by a link 19 to frame 10. The position of link 19 is governed by a link 20 attached firmly to a cog 21 which is fixed in position but free to rotate on frame 10. Cog 21 meshes with a cog 22 whose angular position is determined by an arm 23 fixed thereto and engaging on one of a set of control cams 24 which are mounted coaxially on an axle 25 which rotates in frame 10 when the machine is used.

Cams 24 control the open action of the various components of the wrapping station of the machine, which consists principally of the following:

hydraulic package lift 26
conveyor 27
ring clamp 28
four primary folding blades 29
four secondary folding blades 30
two pack clamps 60
a central mounting unit for the folding blades 31
an actuation linkages for the folding blades 32
(for blades 29) and 33 (for blades 30) Similar linkages (not shown) operate clamps 60 mounted on levers 61.

Figure 2:
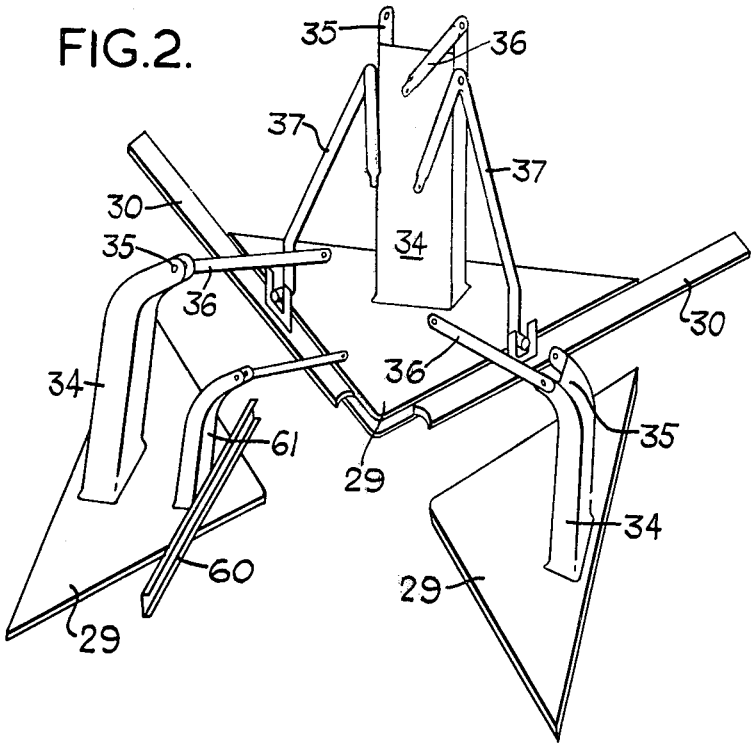
FIG. 2 is a schematic perspective view of five of the eight folding blades and one of the two clamps of the machine of FIG. 1.

The details of the folding blades are more evident from FIG. 2 which is an assembled slightly exploded perspective view from the above of the main components. The four primary folding blades 29 are each supported on a post 34, the upper end of which is pivotally mounted on frame 10, at pivot 35. A crank arm 36 projects from each post 34 and these four arms engage together in a common groove in a vertically movable sleeve (not shown). This sleeve surrounds part of linkage 33 and is moved up and down by linkage 32. As linkage 32 is actuated (by means of cams 24), the sleeve moves up and down and the four primary folding blades 30 spread apart or close together. The package clamps 60 may be similarly actuated by suitable linkages from cams 24.

Figure 3:
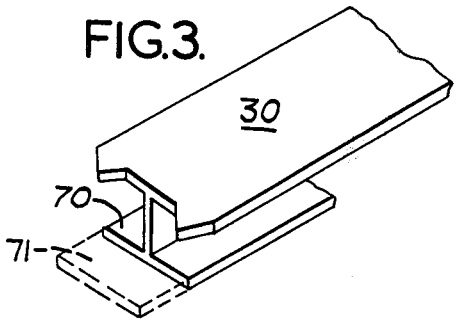
FIG. 3 is a detail perspective view of the aid of a second folding blade.

Mounted slidably at the edges of two of the primary folding blades 29 are a pair of secondary folding blades 30 which may be fitted with shoes and shoe extensions to control the lay of the foil just prior to pleating. This is shown in FIG. 3 in which the shoe is elevated 70 and a show extension 71. The movement of these is controlled by the positions of crank arms 37 which are each pivotally mounted on post 34. The four ends of arms 37 remote from blades 30 are all connected to a crosspiece (not shown) mounted on one link of linkage 33. Thus, when linkage 33 is actuated (by bearing on one of cams 24) the inner ends of crank arms 37 attached to the cross piece move up or down together, and the four secondary folding blades 30 accordingly move together or apart respectively. The clamps 60 hold the pack whilst the lift 26 descends to clear jaws 29.

The sequence of operation of the machine in use is as follows:

A package to be overwrapped is placed on an inlet conveyor (not shown) and fed thereby onto conveyor 27. Conventional photocell-controlled means then stop conveyor 27 when the package is in a central position below clamps 28. At this stage, clamps 28 are apart and carriage 15 advances between them, grasps foil from roll 11 in the jaws 15 and retracts, pulling the foil across clamps 28 and above the package to be wrapped. Clamps 28 are then gently closed and hydraulic package lift 26 operated to raise the package up into the foil and through ring clamps 28. At this point the folding blades 29 and 30 are all spread open so the package now with foil draped over it rises to a level just above that of the blades 29 and 30 when closed. As this takes place, jaws 15 release one edge of the foil wrap and hot wire 13 cuts the foil to form the other edge. Clamps 26 are kept slightly applied to tauten the foil. Clamps 60 are advanced to hold the package at about this point in the operation.

Linkage 32 is now operated to bring the four principal folding blades 29 together and so fold the draped foil under the package, leaving pleats of foil hanging through the cruciform form gaps between the blades 29.

Linkage 33 is now operated to move secondary folding blades 30 together, this causing the pleats to be bunched up to form four neat ribs below the package. The action of the folding blades pulls the foil clear from clamps 28.

Linkages 32 and 33 are now operated (by further rotation of cams 24) to spread blades 29 and 30 and thus release the package and package lift 26 is lowered to place the package back onto conveyor 27, by which it is then removed from the wrapping station and (by conveyor means not shown) subsequently removed from the machine. If desired the machine may include a heating tunnel through which the wrapped package passes between conveyor 27 and ejection.

It is to be understood that, in addition to the components shown, the wrapping machine of FIG. 1 includes motors, control switches and valves and the like to enable the cooperative functioning of the components in the manner just described. The arrangement and construction of these not illustrated devices is, however, common knowledge in the field, and easily effected by the manufacturer of such a machine. Examples of these types of components are micro-switches or other sensors to determine when foil supplies run low or to check, e.g. that the carriage 14 has picked up the foil and transported its leading edge over the package.

Various modifications to the apparatus shown in FIGS. 1 and 2 may be made: for example, the simple feed from a stock roll via a feed check means may be replaced by a system comprising stock roll, idler rollers, one or more spreader rollers (for example rollers wound with two helixes of raised cloth extending symmetrically from the centre) and a pair of nip rolls, one of which may be driven to pull foil from the stock roll. The driven roll and the stock roll may be provided with electromagnetic or other brake means to prevent overrun and speed adjustments to overfeed or underfeed the foil relative to the speed of the jaws 15.

In order to pull the foil across over the package, carriage 14 may be driven in other ways; for example, instead of the cog and arm linkage shown, a continuously driven endless chain may extend along the frame of the machine in an elongated loop. The carriage may bear two pawls, each electromagnetically operated which will allow the carriage to engage either the forward or the return run of the chain. Control of the movement of the carriage may be effected by known methods. The clamp 15 on the leading edge of the carriage may be replaced by a suction bar of known type. Alternatively carriage 14 may be dispensed with and foil feed forward of the cutter 13 obtained by means of vacuum belts.

Clamping rings 28 may be replaced by two pairs of clamping bars.

The hydraulic package lift 26 may be replaced by a package lift working on a vertical drive linkage, operated for example by a motor. The table of the package lift may bear or have inset a tamping head or a hot plate to assist the sealing of the finished foil. This may be operated, for example, via a bowden cable linkage between suitable actuation means and the tamping head itself. The tamping head may be merely vertically movable, or it may be vertically movable and twistable about a vertical axis. The tamping head may be heated.

The package clamps 60 may be of shape appropriate to a particular overwrapping task, e.g. curved for overwrapping cabbages.

Figure 4:
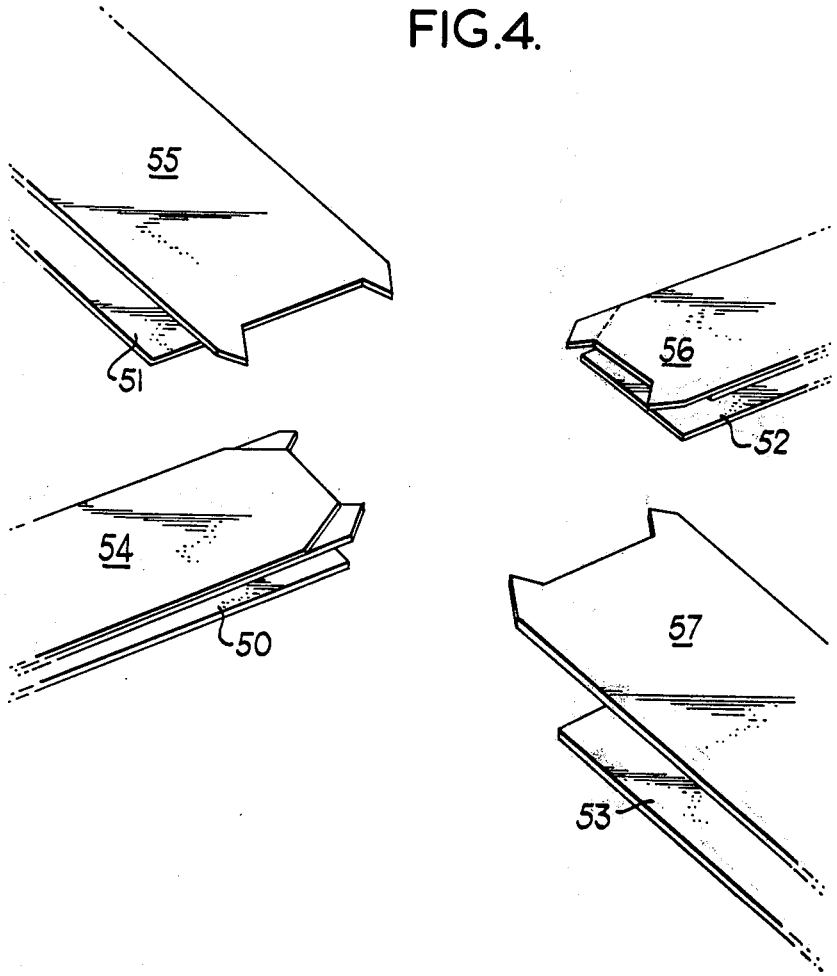
FIG. 4 is an upside-down perspective view of an alternative configuration for the second folding blades.

The action of the secondary folding blades as shown in FIG. 2, is to bunch excess foil into a tight circular bundle in the middle of the package. FIG. 4 shows an alternative arrangement. Referring to this figure each blade consists of a base 50, 51, 52, 53 and an upper blade secured thereto 54, 55, 56, 57. Bases 50 – 53 are coplanar. Blades 54 and 56 are coplanar, as are blades 55 and 57, but blades 55 and 57 are further removed from their associated bases than are blades 54 and 56.

The drive and mounting of these blades is similar to that shown in FIG. 2, with the exception that blades 54 and 56 are arranged to mate first, before blades 55 and 57 meet.

In use of the blades as in FIG. 4, blades 54, 56 first advance together, bunching two opposite pleats of hanging excess foil into two ribs. Bases 50, 52 almost meet and squash the surplus foil into a flat bundle, and blades 54 qnd 56 cooperate likewise. Thereafter the other two folding blades advance to meet. Bases 51 and 53 squash the excess foil into a flat bundle against the sides of bases 50, 52, while blades 55, 57 push the flattened bundle so formed over to the top of blades 54, 56 and together. Suitably adjusted with respect to the size of the foil relative to the size of the package, folding blades as shown in FIG. 3 can give a very neat final result.

In some cases it is possible to produce a final package with a flat base despite the presence of the four bunched ribs and possibly the central bundle of foil also; this may be achieved if the tray has a reentrant base; for example packaging trays for four fruits (oranges, apple, tomato) may have four depressions in their base and a central raised area, a corresponding depression as viewed from below.

It will be appreciated that the whole of the wrapping operation using clamps 60 is not gravity dependant and can, if desired be operated the other way up from that described and illustrated.

The apparatus may also be used for semi-automatic operation, in which the foil is normally placed between clamps 28 and the product is manually pushed through the foil membrane until the bottom of the pack is level with jaws 29 and 30. The operation of the jaw linkages 32 and 33 may be manual or powered by arms 24. This system is suitable for the wrapping of cabbage, chicken, etc, without trays, and is generally more convenient to carry out if the wrapping head is the other way up from that shown.

Brushes may be fitted in strategic positions near this blades 29 and 30 to smooth the foil over the package. These brushes may be swung into or out of their operating positions by the action of gravity or solenoids energised by microswitches tripped by cams 24.

We claim as our invention:

1. Apparatus for wrapping articles with foil and comprising foil feed means, clamp means for locating a length of foil fed from said feed means in a position adjacent an article to be wrapped, an article lift located below said clamp means for moving the article relative to the clamped foil so that the foil is draped around the article and, located above said clamp means, a first set of folding blades disposed vertically above the lift, said blades being radially movable from an open position to a closed position in which they at least almost mate to form a closed surface, the mating lines being in the form of a cross to thereby fold the draped foil under the article and leaving pleats of foil hanging through cruciform gaps between the blades, and a second set of folding blades each movable radially from an open position in which each blade is adjacent and just above one of the mating lines between two adjacent blades of the first set to a closed position to thereby bunch the foil pleats.

2. The apparatus of claim 1 including package clamps associated with the folding blades and adapted to hold the package adjacent and just above the folding blades.

3. The apparatus of claim 1 wherein each of the second set of blades is slidably mounted upon one blade of the first set.

4. The apparatus of claim 1 including means for supporting a stock roll of wrapping foil, means for advancing foil from the stock roll, means for cutting a section of foil from the roll and means for feeding the cut section of the foil to a position centrally the article lift.

5. The apparatus of claim 2 including a tamping means centrally located on the article lift.

6. The apparatus of claim 2 including means for applying heat to the wrapping foil to provide a heat sealing or heat shrinking effect.

* * * * *